US007341459B1

(12) United States Patent
Robinette et al.

(10) Patent No.: US 7,341,459 B1
(45) **Date of Patent: *Mar. 11, 2008**

(54) MULTI-SIGNAL SINGLE PIN CONNECTOR

(75) Inventors: Dale Thomas Robinette, Poway, CA (US); Jose R. Estevez, York, PA (US); Kimberly A DeBock, Hummelstown, PA (US); Graham H Smith, Jr., Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/849,516

(22) Filed: Sep. 4, 2007

Related U.S. Application Data

(63) Continuation-in-part of application No. 11/558,485, filed on Nov. 10, 2006, now Pat. No. 7,278,854.

(51) Int. Cl.
*H01R 12/00* (2006.01)

(52) U.S. Cl. ..... 439/53

(58) Field of Classification Search ..... 439/53, 439/668, 669
See application file for complete search history.

(56) References Cited

U.S. PATENT DOCUMENTS 4,897,055 A * 1/1990 Jurista et al. ..... 439/699.1
5,409,403 A 4/1995 Falossi et al.
5,575,688 A 11/1996 Crane, Jr.
6,267,625 B1 * 7/2001 Gugliotti et al. ..... 439/608

* cited by examiner

*Primary Examiner*—Phuong Dinh

(57) ABSTRACT

A connector system is disclosed. The connector system includes a single-pin plug that has at least two conductors electrically isolated from one another to provide two separate electrically conductive surfaces to facilitate simultaneously transmitting two different electrical signals through the pin at the same time. The connector system further includes a socket to receive the single-pin plug. The socket includes electrically isolated conductors to independently contact different conductive surfaces of the plug.

18 Claims, 9 Drawing Sheets

MULTI-SIGNAL SINGLE PIN CONNECTOR

CROSS-REFERENCE TO RELATED APPLICATIONS

This application is a continuation-in-part of U.S. application Ser. No. 11/558,485, filed Nov. 10, 2006, which is hereby incorporated by reference in its entirety.

FIELD OF THE INVENTION

The present invention is directed to electrical connectors and more particularly to a single pin connector configured to carry multiple electrical signals.

BACKGROUND OF THE INVENTION

In electronic circuits, the use of increasingly higher speed switching signals has necessitated control of impedance for signal transmission. This is commonly accomplished through the use of shielded twisted pairs in cable to cable connections and differential pairs in connections involving a printed circuit board. Existing differential pair or shielded twisted pair connectors designed to address this need generally make use of individual pins to carry separate signals.

These types of high speed connector systems are often desirable for use in applications, such as avionics, for example, in which the size and weight of connectors should be small, yet signal density is desired to be as high as possible. However, because existing differential and shielded twisted pair connectors make use of multiple pins, the contacts have the disadvantage of being very small and fragile in these types of applications. This has the further shortcoming in that, particularly in avionics and/or military applications, the connectors are often used in rugged environments in which fragility poses a risk that the connector will fail to operate properly. Thus, a choice must often be made between higher communication speeds with lower reliability or lower speeds with increased reliability.

Current connector systems in these applications have thus failed to adequately carry multiple signals in a robust reliable package. While other types of connector systems, such as those used in conventional stereo applications, carry multiple signals in a more robust single pin, the pins do so over a single conductive surface and do not have the ability of being impedance matched with a corresponding jack. As a result, such devices have high noise and cannot provide high signal transfer speeds.

These and other drawbacks are found in current connector systems.

What is needed is a connector system that has increased speeds, but retains high reliability, even at high signal density.

SUMMARY OF THE INVENTION

According to an exemplary embodiment of the invention, a single pin plug is disclosed. The single pin plug comprises a first conductor, a second conductor and an insulator electrically isolating the first conductor and the second conductor. The conductors and the insulator are separate components of a single pin plug, the first conductor and the second conductor providing independent conductive surfaces of the plug. Each conductor is individually connected to a different tail extending internal the plug to a connection point external the plug and arranged to carry a different electrical signal through the plug.

According to another exemplary embodiment of the invention, a connector system is disclosed. The connector system comprises a single pin plug and socket configured to receive the single pin plug. The plug comprises a first plug conductor and a second plug conductor and a plug insulator electrically isolating the first plug conductor and the second plug conductor. The plug conductors and the plug insulator are separate components of a single pin plug, the first plug conductor and the second plug conductor providing independent conductive surfaces of the plug, each plug conductor individually connected to a different tail extending internal the plug to a connection point external the plug and arranged to carry a different electrical signal through the plug. The socket comprises multiple socket conductors electrically isolated by at least one socket insulator, the socket configured such that when the plug is in an operable position within the socket, at least a portion of each plug conductor is independently in substantial registration with a corresponding socket conductor.

One advantage of certain exemplary embodiments of the invention is that multiple signals are carried in a single pin, providing a robust connector that permits impedance matched signals, and consequently achieves higher speeds, even at high signal density.

Another advantage of exemplary embodiments of the invention is that the plug is compatible with both cable-mounted and board-mounted sockets.

Other features and advantages of the present invention will be apparent from the following more detailed description of exemplary embodiments, taken in conjunction with the accompanying drawings which illustrate, by way of example, the principles of the invention.

BRIEF DESCRIPTION OF THE DRAWINGS

Where like parts appear in more than one drawing, it has been attempted to use like reference numerals for clarity.

DETAILED DESCRIPTION OF EXEMPLARY EMBODIMENTS

Exemplary embodiments of the invention are directed to a connector system having a plug that carries two or more different electrically isolated signals in a single pin. By incorporating multiple isolated conductors into a single pin, the plug achieves signal transfer over an area smaller than two separate pins as found in conventional devices, yet because the plug's single pin is of a larger diameter, it is more robust and less fragile, which is particularly advantageous for use in rugged applications, such as military and avionics devices.

Figure 1B:
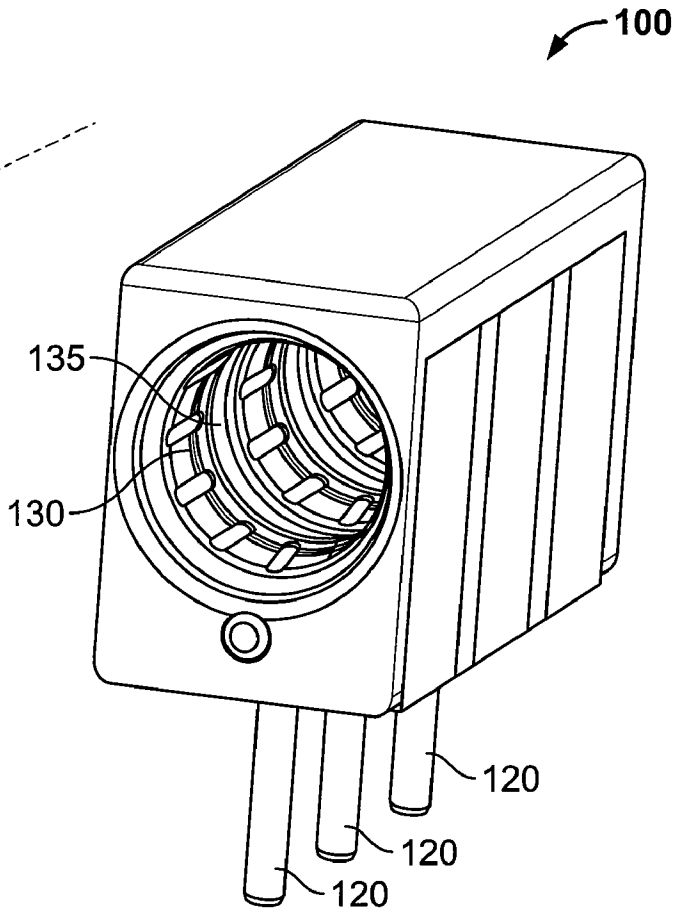
FIG. 1*b* illustrates a socket in accordance with an exemplary embodiment of the invention.
Figure 1A:
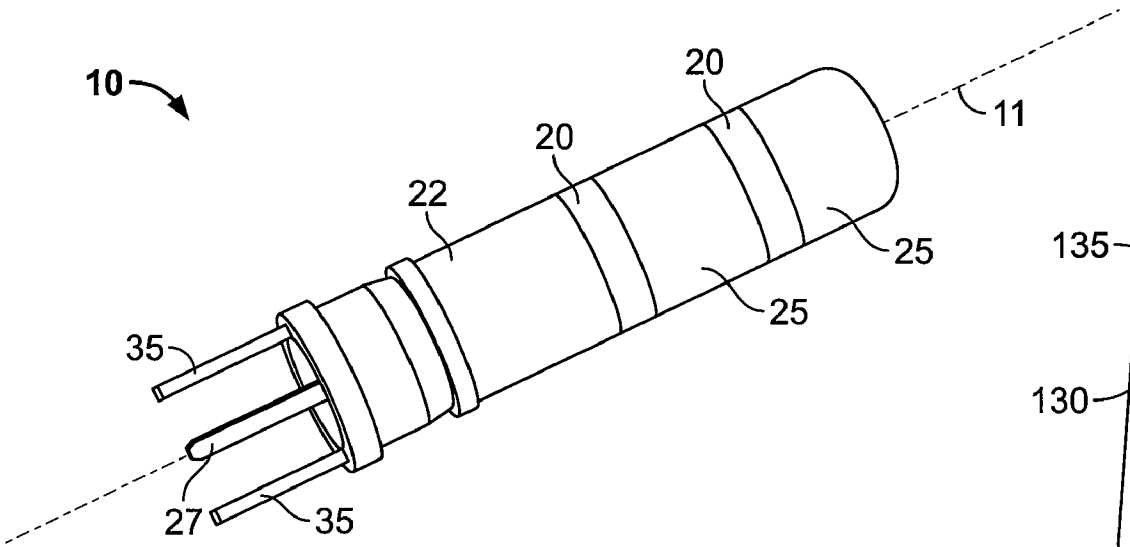
FIG. 1*a* illustrates a plug in accordance with an exemplary embodiment of the invention.

Referring to FIG. 1*a*, a single pin plug 10 includes at least two electrical conductors 25 for carrying an electrical signal, each conductor 25 having an exposed conductive surface, separated by one or more insulators 20. The plug 10 is preferably cylindrical, although any desired geometry may be employed. The plug 10 may include any number of conductors 25. When used to terminate a cable having one or more pairs of shielded and/or twisted wires (not shown), the plug typically includes an even number of conductors 25. When used to terminate a printed circuit board (also not shown) the plug 10 may also include an even number of conductors 25, although two, three, four and up to eight or more conductors 25 may be employed in either case.

Figure 2A:
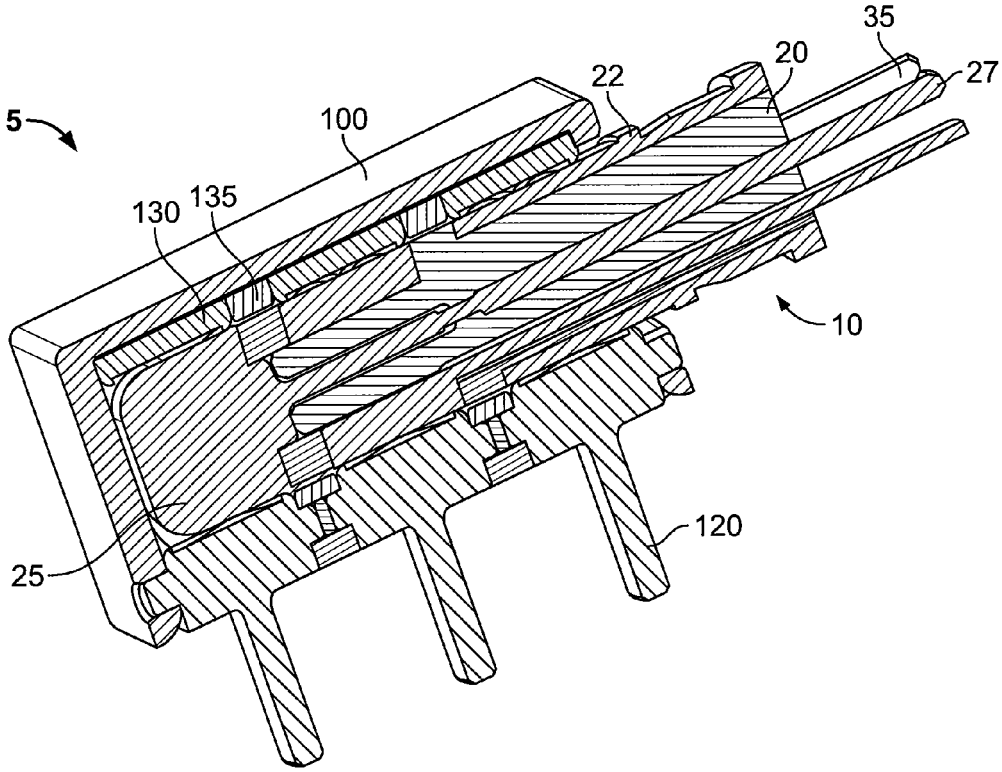
FIGS. 2*a* and 2*b* illustrate cross-sectional views of a mated and unmated connector system in accordance with an exemplary embodiment of the invention.

As seen better in the cross-sectional view shown in FIG. 2*a*, which illustrates a complete connector system 5, each conductor 25 of the plug 10 independently terminates at a point external to the plug 10 via a corresponding tail 27. The tails 27 pass internally through the plug 10, and like the conductors 25, are electrically isolated from one another by the insulator(s) 20.

In most cases, the cable, circuit board or other device terminated by the plug 10 will include a ground. Thus, the plug 10 preferably also includes a connection to ground. The ground connection may be achieved by a conductive shell 22 that surrounds a portion of the insulator 20 and which electrically isolates it from the conductors 25.

In one embodiment, the conductor tails 27 pass internally through the plug 10 while the outer shell 22 extends externally over a periphery of the plug 10 to one or more ground tails 35. Although the insulator 20 effectively isolates the conductive components of the plug 10 for simultaneously transmitting separate signals, passing both the ground connection (via ground tails 35) and the signal connections (via conductor tails 27, shown aligned in FIG. 1*a*) internally through the plug 10 may result in undesirable cross-talk between the signals carried by the conductors 25. Separating the ground connection as far as possible from the signal connections may minimize the impact of any cross-talk.

Any sufficiently electrically conductive material may be used for the conductors 25 and the outer shell 22. Exemplary materials include tin, copper, gold, silver, aluminum, nickel, platinum, palladium and alloys thereof. The conductors 25 may be of unitary construction or may comprise a bulk conductive material over which one or more layers of a different conductive material is plated or otherwise applied.

The insulator 20 is configured to separate the conductors 25, and any outer shell 22, a predetermined distance from one another to achieve a desired overall impedance of the plug 10. The types of insulating materials used in the plug 10 may be any sufficiently electrically insulating material, although the particular material selected may depend on the overall impedance desired to be achieved in the plug 10, as well as the production technique, such as whether the insulator 20 is desired to be manufactured by machining or injection molding, for example. Suitable insulating materials include tetrafluoroethylene, nylon, polyethylene, polypropylene and combinations thereof, by way of example only.

The conductors 25, insulator 20 and any outer ground shell 22 are components that together form the plug's single pin. These components may be held together in any fashion, such as by soldering or adhesive, as well as by interference fit. The overall size of the plug 10 may be any suitable size, but is particularly suitable for use in applications where connectors are desirably small. Thus, the plug 10 may be about size 8 or about size 12 and may even be about size 16 or smaller, based on standard gauge measurements.

FIG. 1*b* illustrates a socket 100 in which the plug 10 may be inserted to form a complete connector system 5. The socket 100 is staged, with a socket insulator 135 that electrically isolates a plurality of socket conductors 130. The number of socket conductors 130 generally corresponds to the total number of plug conductors 25 plus any outer shell 22. The socket insulator 135 is configured to stage the socket conductors 130 within the socket 100 such that when a corresponding plug 10 is inserted into the socket 100, at least a portion of each of the plug conductors 25 is independently in substantial registration with a corresponding socket conductor 130. As shown in the embodiment illustrated in FIG. 1*a*, the insulator 20 laterally separates the plug conductors 25 along a longitudinal axis 11 of the plug 10, each of which plug conductors 25 has an exposed conductive surface that forms a complete ring around the plug 10. As a result, the plug 10 can be inserted into the socket 100 at any orientation and may be rotated within the socket 100 without interrupting the electrical connections between respective plug conductors 25 and socket conductors 130.

Figure 2B:
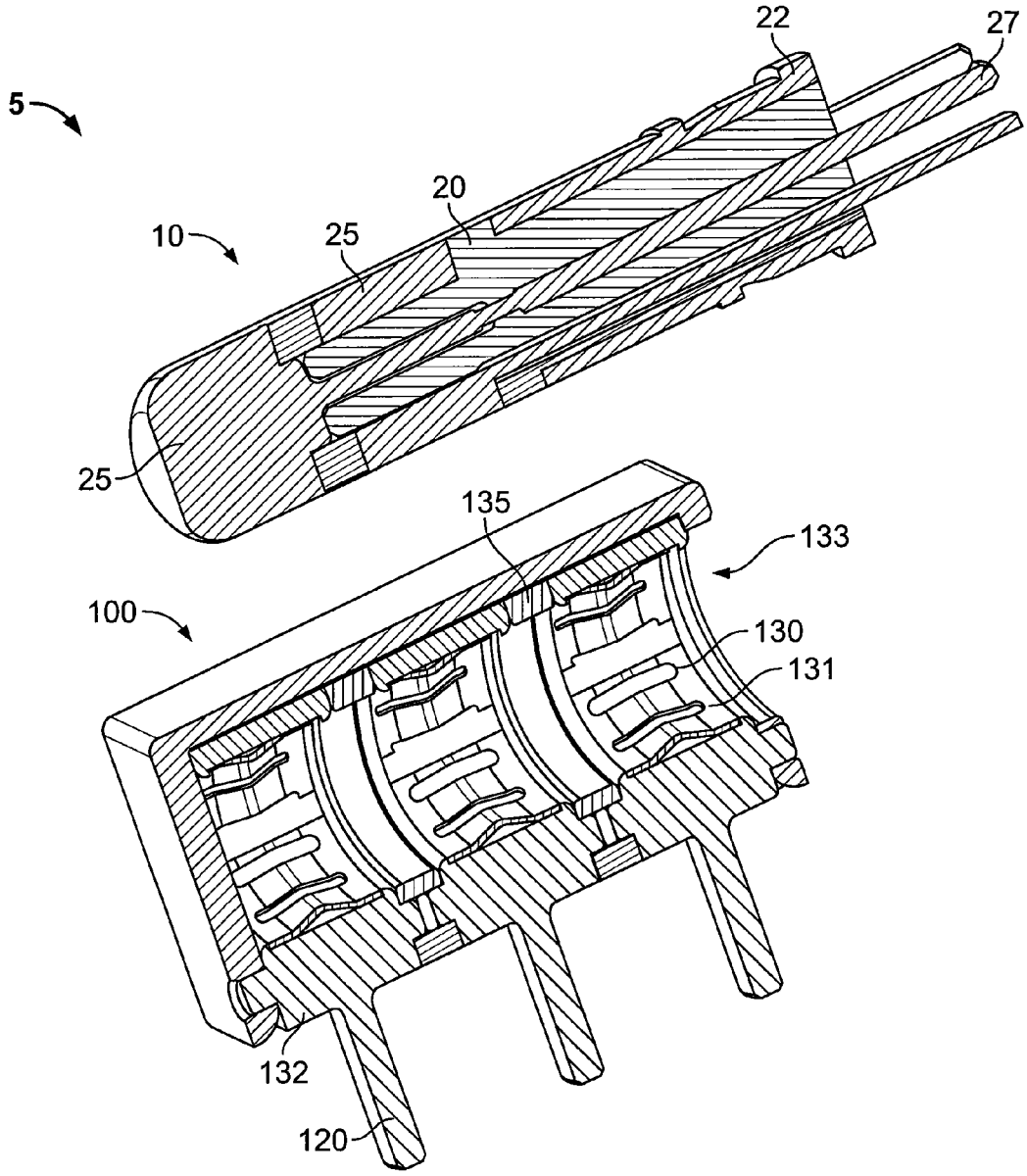

The socket conductors 130 at least partially surround the plug 10 when inserted and are positioned to contact the plug 10 to complete multiple circuits. As better seen in FIG. 2*b*, according to one embodiment of the invention, a socket conductor 130 comprises a conductive block 132 with an aperture 133 therethrough. Optionally, a conductor ring 131 is positioned within the aperture 133. In either case, the socket conductors 130 independently carry electrical signals to or from the plug 10 to a point external to, and terminated by, the socket 100, such as a printed circuit board or one or more cables, typically containing at least a pair of wires that may or may not be shielded and/or twisted. As illustrated in FIG. 2*b*, the socket 100 is a board-mounted socket, in which electrical signals pass through the socket 100 via press-fit or solder tails 120 that may be used to carry electrical signals as well as to attach the socket 100 to a printed circuit board.

The conductor rings 131 are illustrated as louvered, although solid bands may also be used instead. Alternatively, conductor rings 131 may be omitted entirely with electrical connection achieved by direct contact between the plug conductors 25 and the conductive block 132 of the socket conductor 130. Louvered conductor rings 131 increase the robust nature of the socket 100, and of the entire connector system 5, by introducing multiple contact points. This introduces a redundancy that helps provide continued signal transmission in the event of a break in the conductor ring 131 that might otherwise result in an open circuit. The louvered conductor rings 131 may additionally decrease the amount of force associated with insertion and/or retraction between the plug 10 and socket 100.

The conductive blocks 132 and the conductor rings 131 of the socket conductors 130 may be any sufficiently electrically conductive material, such as those previously described with respect to the plug conductors 25. Likewise the insulating material for the socket insulator 135 may be any sufficiently insulating material, such as those previously described with respect to the plug insulator 20.

The sockets 100 may be sized and dimensioned in any manner that provides suitable contact with the plug 10, and may be sized and dimensioned to correspond to any one or more of standards MIL-DTL-38999, ARINC 600, and/or MIL-DTL-24308 by way of example only.

The socket 100, like the plug 10, is configured and arranged to have a predetermined impedance, in which the impedance of the plug 10 and the socket 100 are matched with one another. Thus, the impedance of the plug 10 is generally within about 10% of the socket 100, more typically within about 5% and preferably within about 2%. The plug 10 and the socket 100 may be of any desired impedance, including by way of example only, about 50 ohms, about 75 ohms, about 100 ohms, about 110 ohms or about 150 ohms. By matching the impedance, signal speeds of 1 GB or higher, including speeds of up to about 10 to 12 GB or higher may be achieved. The impedance may be matched using any technique known to those of ordinary skill in the art, including computer modeling techniques.

Figure 3:
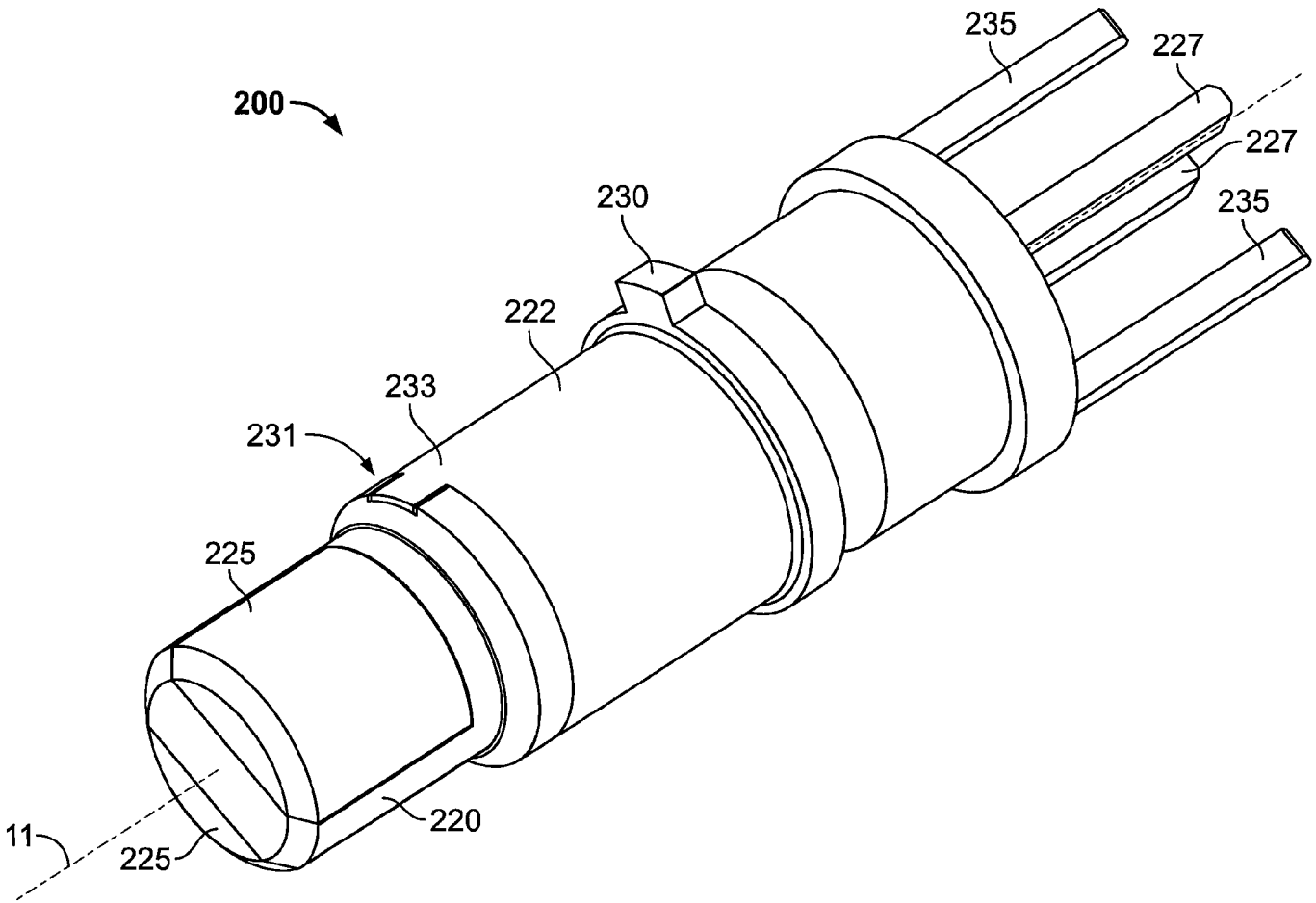
FIG. 3 illustrates a plug in accordance with another exemplary embodiment of the invention.
Figure 4:
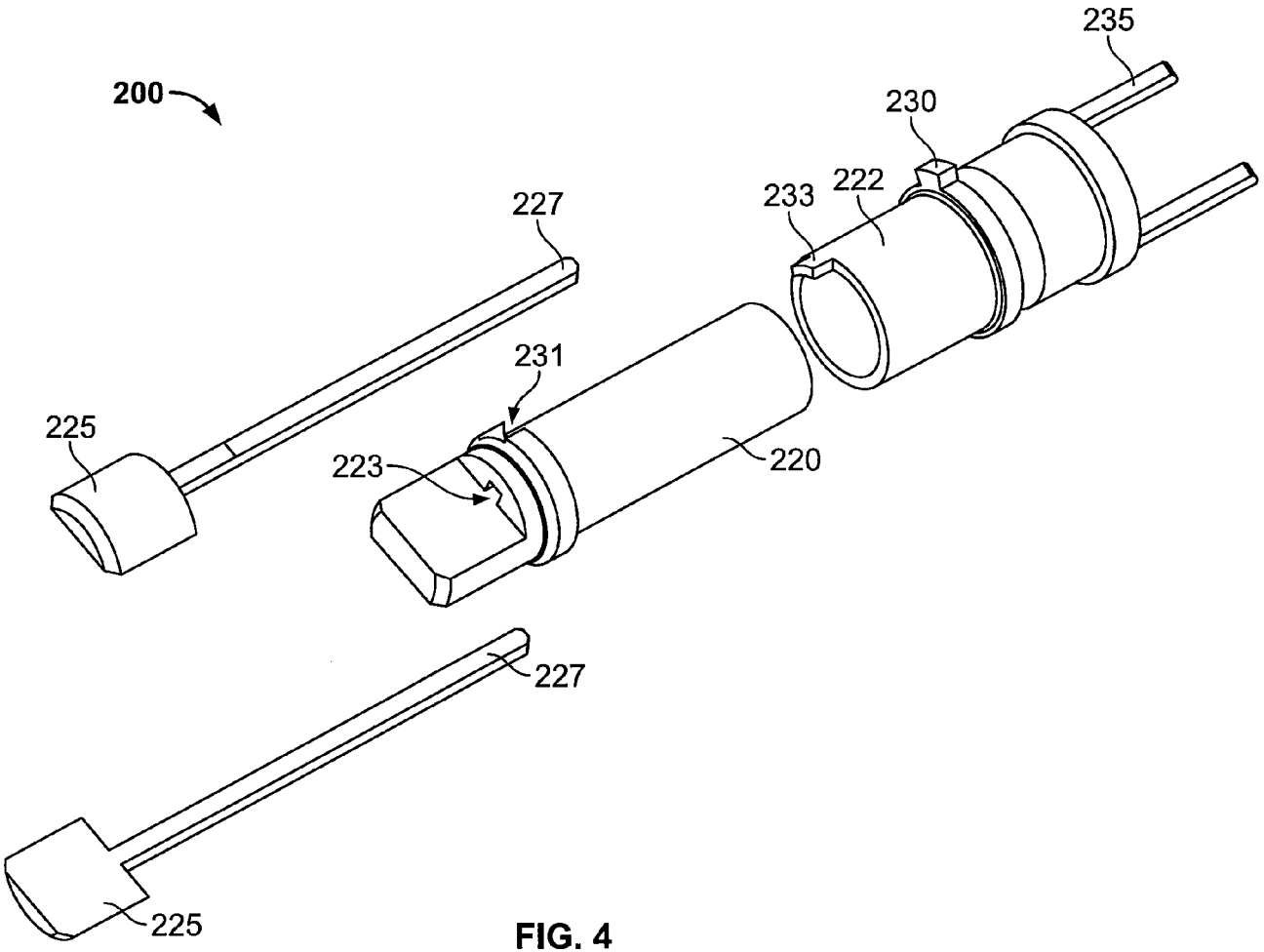
FIG. 4 illustrates an exploded view of the plug illustrated in FIG. 3.

FIGS. 3 and 4 illustrate a single pin plug 200 in accordance with another embodiment of the invention in which the plug 200 includes at least two conductors 225 coextensive the same axial region of the plug 200, which, unlike the embodiment shown in FIG. 1*a*, are separated longitudinally by an insulator 220 with respect to the longitudinal axis 11 of the single pin plug 200. The conductors have tails 227 that pass internal the plug 200 which, as shown in FIG. 4, may be achieved by providing tail-receiving channels 223 in the insulator 220 through which the tails 227 pass and are received.

A conductive outer shell 222 fits over the insulator 220 and may be crimped or otherwise fixed in place in an electrically isolated manner with respect to the conductors 225 to provide a ground connection.

Figure 5:
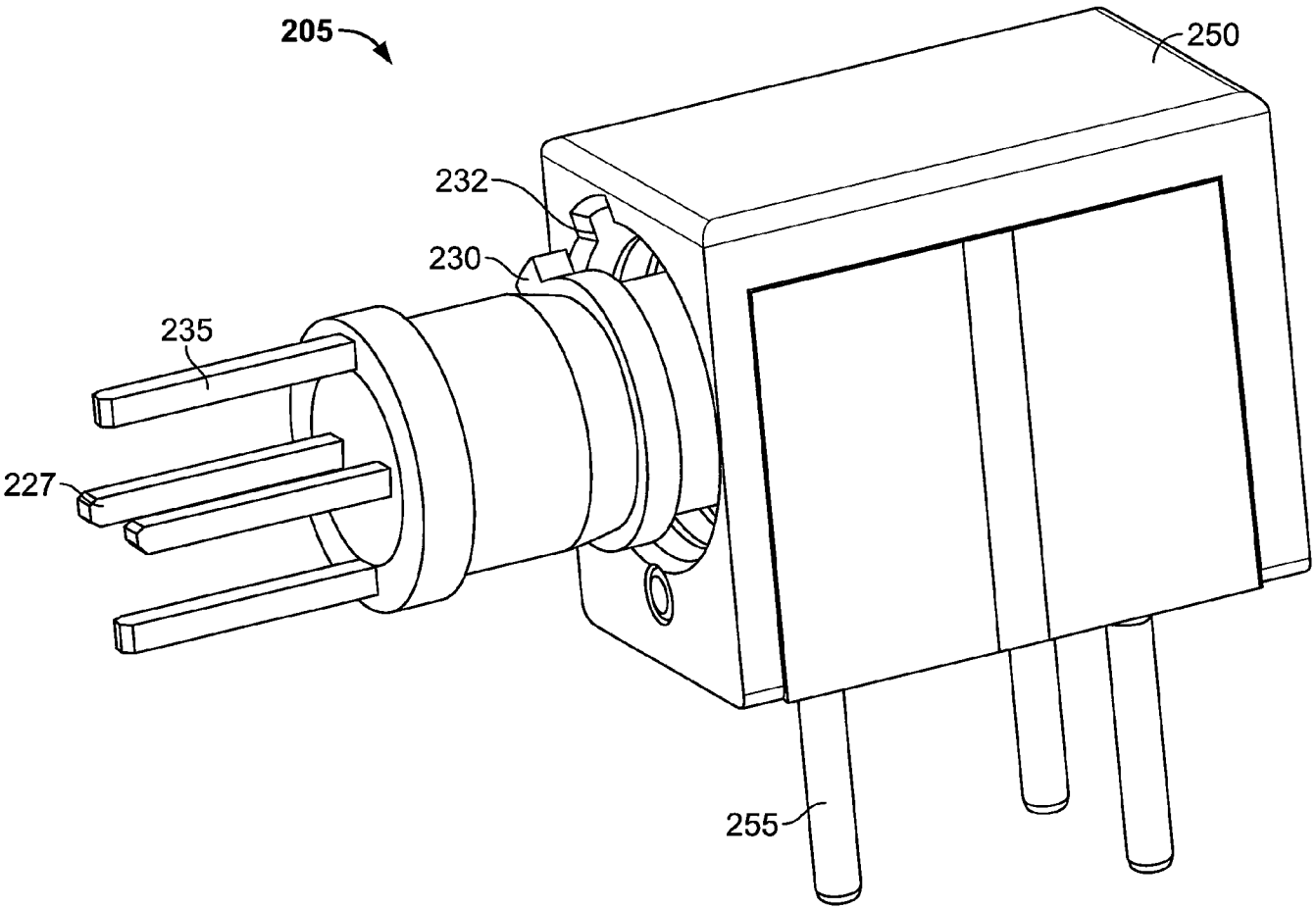
FIG. 5 illustrates a mated connector system in accordance with another exemplary embodiment of the invention.

Because the conductors 225, while electrically isolated, encompass the same axial regions of the plug 200, a key, such as a tab 230 extending radially outward from the outer shell 222, may be provided to properly orient the plug 200 when inserted into a corresponding slot 232 in a socket 250 to form a mated connector system 5 (FIG. 5). Additional keying, such as an axial tab 233, may further be incorporated into the outer shell 222 to mate with a corresponding slot 231 in the insulator 220 and thus ensure that the radial tab 230 itself is at the proper orientation during plug 200 assembly. As illustrated in FIG. 3, the plug 200 may be stepped, resulting in different diameters at different points along its length.

Figure 6:
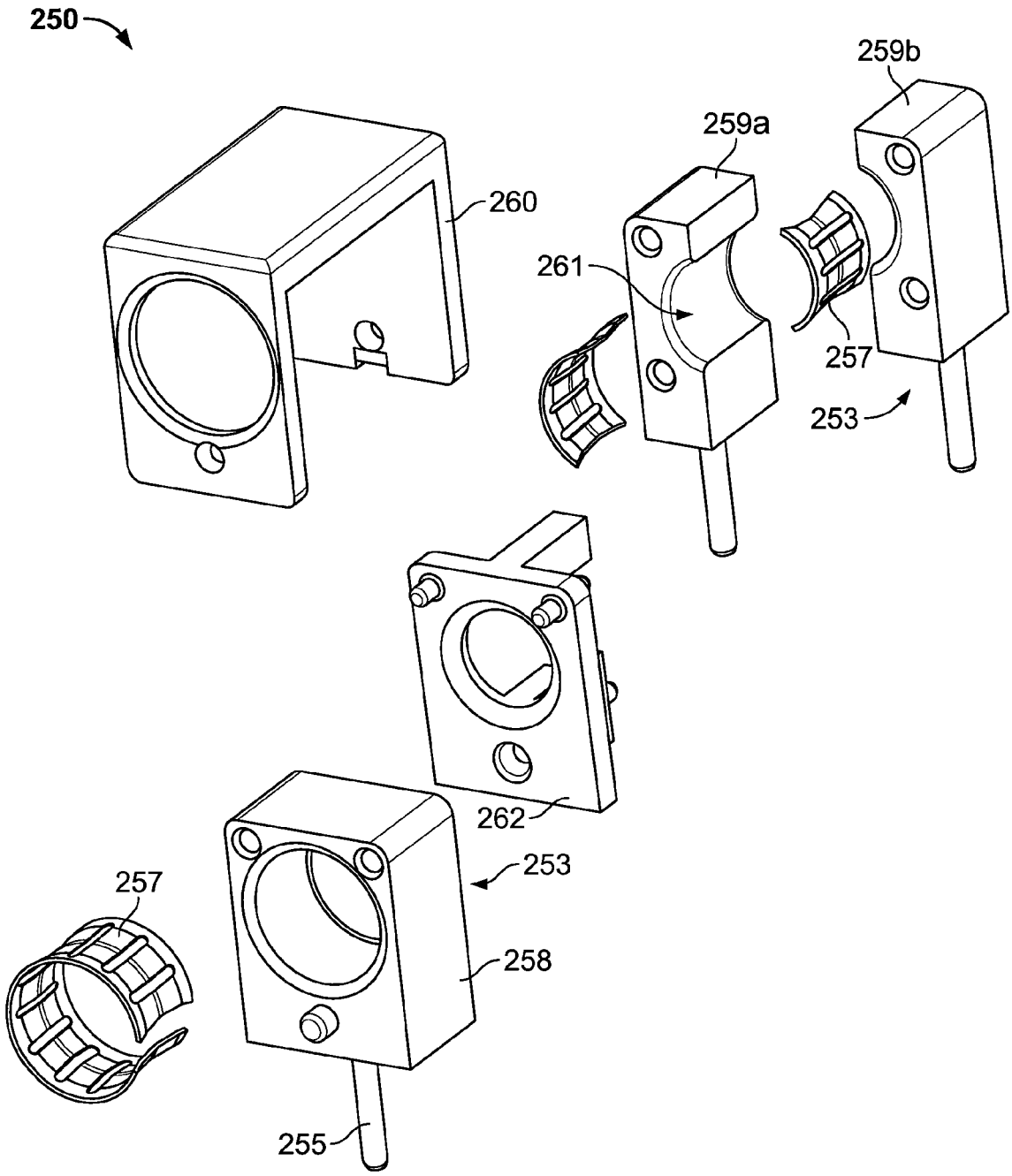
FIG. 6 illustrates an exploded view of a board-mounted socket in accordance with an exemplary embodiment of the invention.

FIG. 6 illustrates an exploded view of the board mounted socket 250 shown in the connected system 205 of FIG. 5. In this embodiment, the socket conductors 253 are arranged in a slightly different fashion to accommodate the alternative configuration of the plug 200 in which at least two conductors 225 are at the same axial points. In this embodiment, two socket conductors 253 are in the form of signal blocks 259*a*, 259*b* provided and arranged in an opposing manner and configured so that each signal block is in electrical contact with only a single conductor 225 of the plug 200. An arcuate portion 261 in the each signal block 259*a*, 259*b* is sized to contact a corresponding conductor 225. Proper alignment is important to avoid a short, which may occur if the conductors 225 are in electrical contact with improper or multiple socket conductors 253. Other socket conductors, such as those used for the ground connection may entirely surround its respective conductive surface of the plug as described previously, with a ground block 258 having an entire conductor ring 257 positioned therein.

Each of the ground and signal blocks has at least one electrically conductive, press-fit or solder tail 255 extending away from the socket 250 for attaching to a printed circuit board as previously described.

The ground block 258 and each of the signal blocks 259*a*, 259*b* are electrically isolated from one another by at least one electrically insulating spacer 262. The spacer 262 may be of any sufficiently electrically insulating material as previously described and is configured to electrically isolate the conductive components of the socket as well as to space those components at a distance from one another to achieve a predetermined impedance. A socket housing 260 retains the socket 250 components in a single assembly.

Figure 7:
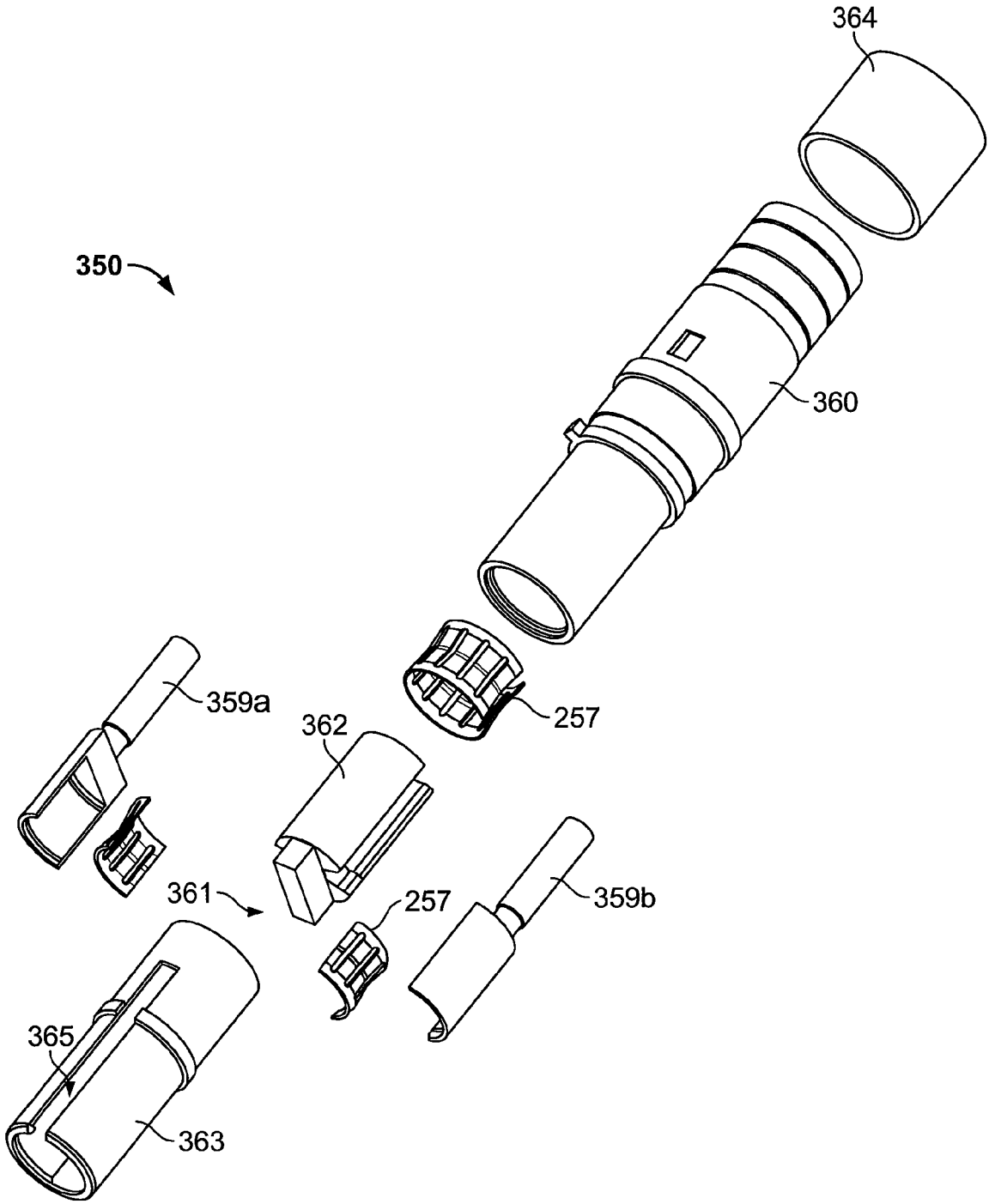
FIG. 7 illustrates an exploded view of a cable-mounted socket in accordance with another exemplary embodiment of the invention.

FIG. 7 illustrates an alternative embodiment with a cable-mounted socket 350 for use in making cable-to-cable connections between a plug and socket, in which the socket 350 is illustrated with respect to the single pin plug 200 shown in FIG. 3. The socket 350 includes a sub-assembly 361 comprising inner signal conductors 359*a*, 359*b* disposed on opposite sides of an insulating spacer 362. The sub-assembly 361 is configured so that the inner signal conductors 359*a*, 359*b* correspond with the plug conductors 225 when the plug 200 is inserted into the socket 350.

The sub-assembly 361 is positioned within an annular insulator sleeve 363 having a longitudinal channel 365 that is configured to receive the radial tab 230 of the plug 200 and ensure proper alignment of the conductors 225 with respect to their corresponding inner signal conductors 359*a*, 359*b* and any accompanying conductor ring portions 257. A conductive outer sleeve 360 surrounds the insulator sleeve 363 and the subassembly 361 contained therein. A crimp ferrule 364 may be provided to terminate the cable and/or to retain the socket 350 in an assembled manner.

Figure 8:
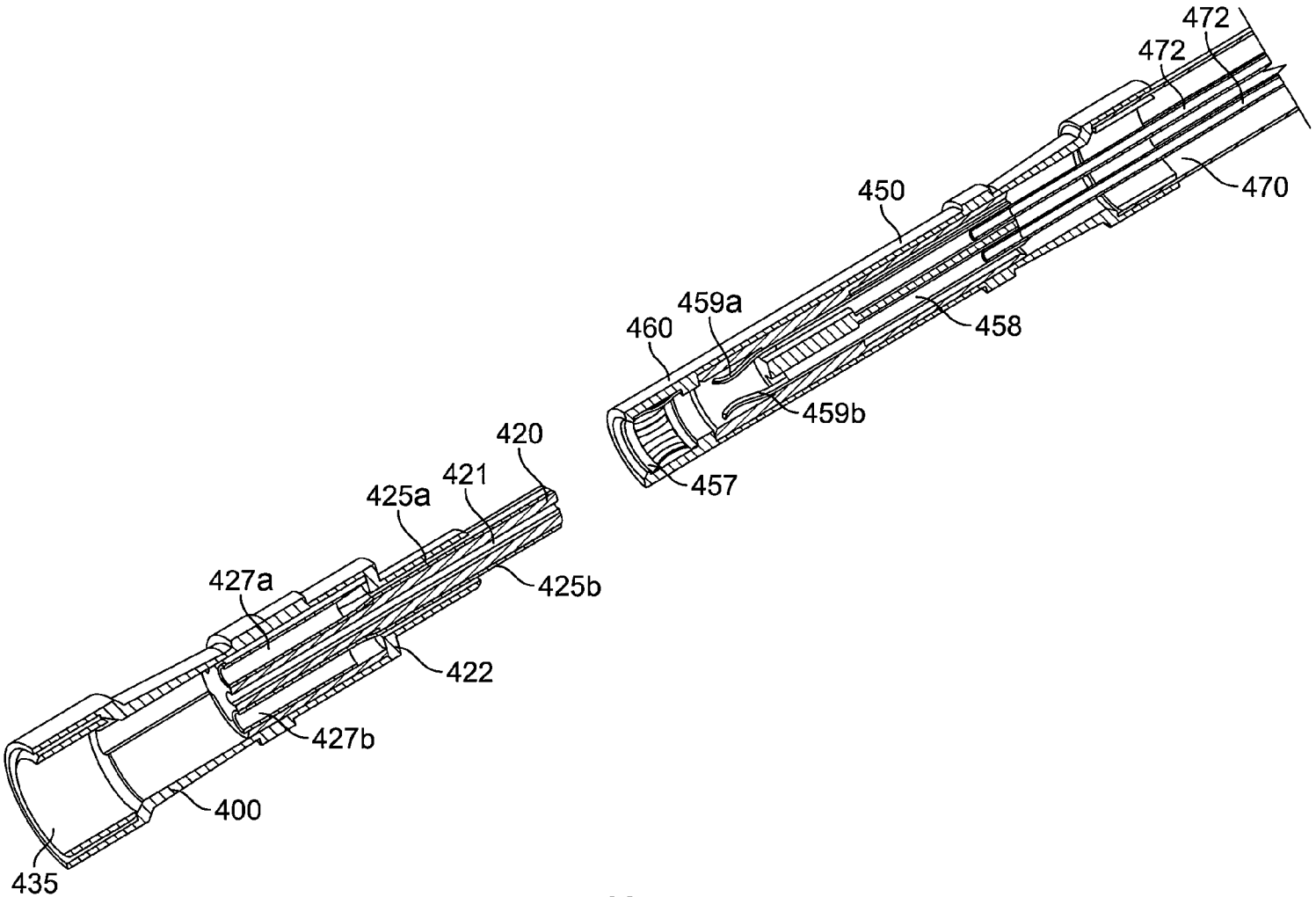
FIG. 8 illustrates a connector system in accordance with yet another exemplary embodiment of the invention.

FIG. 8 illustrates a connector system in accordance with yet another exemplary embodiment of the invention. The connector system includes a split pin plug 400 similar to that previously shown and described in FIG. 3 having a first conductor 425*a* and a second conductor 425*b* at a common axial region, while also being separated by an insulator 420. As shown in FIG. 8, the insulator 420 contains a void core 421. By introducing voids, such as a void core 421, in the insulator 420, air pockets are created which can assist in achieving a desired impedance level for the plug. The insulator 420 also electrically isolates the first and second plug conductors 425*a*, 425*b* from the conductive outer shell 422. It will be appreciated that the plug 400 may be manufactured and assembled in a way that the insulator 420 is a single component of dielectric material or multiple separate components to achieve the electrical isolation between the various conductors of the plug 400 and in separating the conductors to achieve a predetermined impedance level of the plug 400.

Each of the first and second conductors 425*a*, 425*b* include respective termination regions, which are typically tails 427*a*, 427*b*. The tails 427*a*, 427*b* extend internal the plug 400 and may be used to connect a cable or other device that is terminated by the plug 400. Thus, the first and second plug conductors 425*a*, 425*b* are each configured to carry a different electrical signal.

Still referring to FIG. 8, the connector system also includes a socket 450 configured to receive the plug 400 and contains multiple socket conductors such that when the plug 400 is inserted to an operative position within the socket 450, the first and second conductors 425*a*, 425*b*, and the conductive outer shell 422 are each in substantial registration with a corresponding socket conductor. As previously described, keying features may be provided so that the plug's signal conductors 425*a*, 425*b* mate with, and stay in contact with, the appropriate corresponding socket signal conductors 459*a*, 459*b*. In this embodiment, a conductor ring 457 is provided to contact the conductive outer shell 422, while spring beam conductors 459*a*, 459*b* are provided to contact the first and second conductors 425*a*, 425*b*, respectively. The use of spring beam conductors as the socket conductors 459*a*, 459*b* to contact the first and second plug conductors 425*a*, 425*b* may further assist in reducing the amount of conductive material within the socket 450 and thus in achieving a desired predetermined impedance.

As discussed previously and further illustrated in FIG. 8, plugs and sockets in accordance with exemplary embodiments of the invention can be used to terminate one or more cables 470 containing one or more shielded, twisted pairs of wires 472. Each of the wires 472 in the shielded twisted pair can be separately crimped into a wire crimp section 458 of the spring beam conductors 459*a*, 459*b*. In a similar fashion, a ground wire (not shown) within the cable 470 can be connected to the conductive outer shell 460 of the socket 450 to electrically connect the conductive outer shell 422 of the plug 400 via the conductive ring 457.

Where the plug 400 and/or socket 450 are terminated by a cable 470 containing shielded, twisted pairs of wires 472, signal transmission may be enhanced by creating each of the plug conductors 425*a*, 425*b* of the same size and length as well as providing for the same exposed surface area for conducting electric signals to the respective socket conductors 459*a*, 459*b*, which like the plug conductors, may be of the same size and length to achieve best results.

While the foregoing specification illustrates and describes exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A connector system comprising:

a single pin plug, the plug comprising a first plug conductor and a second plug conductor, and a plug insulator electrically isolating the first plug conductor and the second plug conductor;

wherein the plug conductors and the plug insulator are separate components of a single pin plug, the first plug conductor and the second plug conductor providing independent conductive surfaces of the plug, each plug conductor individually connected to a different tail extending internal the plug and arranged to carry a different electrical signal through the plug;

and further comprising a conductive outer shell electrically isolated from the plug conductors and passing externally the plug to at least one ground connection point, wherein the insulator is configured to separate the first plug conductor, the second plug conductor, and the conductive shell a predetermined distance from one another to achieve a desired overall impedance for the single pin plug and wherein the first and second conductors are at a same axial region of the single pin plug and wherein conductive surfaces of the first and second conductors are longitudinally separated by an insulator with respect to a longitudinal axis of the single pin plug; and a socket comprising multiple socket conductors configured to receive the single pin plug.

2. The connector system of claim 1, wherein the single pin plug further comprises means for orienting the single pin plug with the socket.

3. The connector system of claim 1, wherein the multiple socket conductors include at least one spring beam conductor.

4. The connector system of claim 1, wherein the socket is configured to attach to a printed circuit board.

5. The connector system of claim 1, wherein the socket is attached to a cable comprising at least one pair of wires.

6. The connector system of claim 4, wherein the pair of wires is a shielded, twisted pair.

7. The connector system of claim 1, wherein the socket further comprises at least one socket conductor to electrically contact the plug's conductive outer shell.

8. The connector system of claim 7, wherein the socket conductor to electrically contact the plug's conductive outer shell comprises a louvered conductor ring.

9. The connector system of claim 1, wherein the plug has a plug impedance value and the socket has a socket impedance value, wherein the values of the plug impedance and the socket impedance are within about 10% of each other.

10. The connector system of claim 1, wherein the plug has a plug impedance value and the socket has a socket impedance value, wherein the values of the plug impedance and the socket impedance are within about 2% of each other.

11. A connector system comprising:

a single pin plug, the plug comprising a first plug conductor and a second plug conductor, and a plug insulator electrically isolating the first plug conductor and the second plug conductor;

wherein the plug conductors and the plug insulator are separate components of a single pin plug, the first plug conductor and the second plug conductor providing independent conductive surfaces of the plug, each plug conductor individually connected to a different tail extending internal the plug and arranged to carry a different electrical signal through the plug;

and further comprising a conductive outer shell electrically isolated from the plug conductors and passing externally the plug to at least one ground connection point, wherein the insulator is configured to separate the first plug conductor, the second plug conductor, and the conductive shell a predetermined distance from one another to achieve a desired overall impedance for the single pin plug and wherein the first and second plug conductors are at a same axial region of the single pin plug and wherein conductive surfaces of the first and second conductors are longitudinally separated by an insulator with respect to a longitudinal axis of the single pin plug; and a socket comprising multiple socket conductors configured to receive the single pin plug, wherein the multiple socket conductors include at least one spring beam conductor.

12. The connector system of claim 11, wherein the multiple socket conductors further include at least one conductor ring.

13. The connector system of claim 11, wherein the multiple socket conductors includes two spring lever conductors and wherein one spring lever conductor is configured to contact the first plug conductor and wherein one spring lever conductor is configured to contact the second plug conductor.

14. The connector system of claim 13, further comprising a conductor ring configured to contact the plug conductive outer shell.

15. The connector system of claim 11, wherein the plug has a plug impedance value and the socket has a socket impedance value, wherein the values of the plug impedance and the socket impedance are within about 10% of each other.

16. The connector system of claim 11, wherein the plug has a plug impedance value and the socket has a socket impedance value, wherein the values of the plug impedance and the socket impedance are within about 2% of each other.

17. The connector system of claim 11, further comprising a cable containing a shielded, twisted pair terminated by the socket.

18. The connector system of claim 11, wherein the first plug conductor and second plug conductor are of the same size and shape.

* * * * *